United States Patent [19]

Beebe

[11] Patent Number: 4,794,753

[45] Date of Patent: Jan. 3, 1989

[54] PRESSURIZED AIR SUPPORT FOR CATALYTIC REACTOR

[75] Inventor: Kenneth W. Beebe, Galway, N.Y.

[73] Assignee: General Electric Company, Schenectady, N.Y.

[21] Appl. No.: 702

[22] Filed: Jan. 6, 1987

[51] Int. Cl.[4] ..... F02C 7/20; F02C 1/00

[52] U.S. Cl. ..... 60/39.32; 60/723; 422/179; 422/221

[58] Field of Search ..... 60/723, 39.31, 39.32, 60/752, 753, 758, 760; 422/179, 221

[56] References Cited

U.S. PATENT DOCUMENTS

| | | | |
|---|---|---|---|
| 3,945,803 | 3/1976 | Musall et al. | 422/179 |
| 4,278,717 | 7/1981 | Aoyama | 422/179 |
| 4,432,207 | 2/1984 | Davis, Jr. et al. | 60/723 |
| 4,432,943 | 2/1984 | Musall et al. | 422/179 |
| 4,556,543 | 12/1985 | Mochida et al. | 422/179 |
| 4,629,605 | 12/1986 | Santiago | 422/179 |

FOREIGN PATENT DOCUMENTS

| | | | |
|---|---|---|---|
| 0179730 | 10/1983 | Japan | 60/723 |

OTHER PUBLICATIONS

82JPGC-GT-24; Design of Catalytic Combustor For Heavy Duty Gas Turbines; Touchton et al.-ASME.
84-GT-54; Update Full Scale Catalytic Burner Testing For Combustion Turbines-Pillsbury et al.-ASME.
EPRI Report AP-2584 Project 1657-1-Final Report, 982-Westinghouse Electric Co.

*Primary Examiner*—Louis J. Casaregola
*Assistant Examiner*—Timothy S. Thorpe
*Attorney, Agent, or Firm*—Jerome C. Squillaro

[57] ABSTRACT

The trend toward improving air quality has caused manufacturers of gas turbines to implement direct catalytic reaction of carbon monoxide or hydrocarbons in the gas turbine combustion path. This requires mounting a catalytic reactor directly in the combustion path of the gas turbine which subjects the reactor to shock and thermal loadings, relative thermal displacements between different materials and leakage of combustion products around the catalytic reactor. A catalytic reactor is mounted within an outer structural lines, whereas a compliant and inflatable inner liner is included to support the reactor bed in the radial direction on a cushion of air derived from the compressor discharge air through an air inlet in the outer liner.

7 Claims, 1 Drawing Sheet

PRESSURIZED AIR SUPPORT FOR CATALYTIC REACTOR

BACKGROUND OF THE INVENTION

This invention relates, in general, to gas turbines; and, in particular to catalytic reactors for accelerating carbon monoxide and hydrocarbon oxidation reactions during the combustion process. More specifically, this invention relates to a reactor support apparatus which is generally positioned between the combustion chamber and the transition zone of a gas turbine.

Concurrent with demands for more electrical power, increased public pressures for good air quality have resulted in stringent requirements regulating allowable gas turbine emissions. Such regulations necessitate recourse to both clean burning fuels and advanced gas turbine combustion systems that produce less objectionable emissions during burning. One preferred method of reducing objectionable emissions is through the use of direct catalytic combustion of the fuel within the gas turbine combustor. Direct catalytic combustion requires the use of a catalytic reactor in the combustion gas stream to achieve low levels of carbon monoxide and unburned hydrocarbons simultaneously with reduced oxides of nitrogen. The catalytic reactors are usually comprised of ceramic or metal substrates which are coated with catalyst materials such as noble metals. The catalytic reactors may be described as cylinders having a cross section which is geometrically shaped such as honeycombed. It is well known that these catalytic reactors operate in an environment of elevated temperatures and consequent thermal changes. Also by nature of a rotating machine environment shock and vibratory loadings sometimes occur. In addition, in the high pressure environment of a combustion chamber it is important that leakage of combustion products out of the combustion path does not occur. It is also well known that ceramic materials are brittle thereby requiring extra attention to the foregoing environment. All in all, it can be concluded that special attention must be given to the support structure for a catalytic reactor if it is to be successfully implemented into a gas turbine for the successful reduction of NOx emissions.

One such specially devised mounting structure for a catalytic reactor is found in U.S. Pat. No. 4,432,207 issued to inventors Davis and Steber, and assigned to the assignee of the present invention. In that patent, a tubular heat shield was interposed between the outer circumference of the reactor bed and the support cylinder in order to permit admission of an adequate amount of purge air: i.e., air which prevents the ingress of combustion products into the space between the reactor and the support cylinder. At the same time, the heat shield prevents overcooling of the reactor by blocking direct impingement cooling of the reactor surface. It should be carefully noted that shock loadings upon the reactor are mitigated through the use of axial support springs which serve to center the reactor within the support structure. The foregoing is exemplary of the state of the art prior to the present invention.

It is an object of the present invention to improve upon the state of the art by providing a catalytic reactor support structure which is less complex than previous known structures.

It is another object of the invention to admit an adequate amount of purge air to prevent the ingress of unburned fuel or products of combustion into the space between the reactor and the support cylinder.

It is another object of the present invention to provide a thermal barrier between the catalytic reactor and the support cylinder without resort to a metal tubular shield.

It is another object of the present invention to protect the reactor against shock loadings by means of an air cushion which surrounds the catalytic reactor.

It is yet another object of the present invention to provide a support for a catalytic reactor which will automatically recenter the catalytic reactor if it is displaced in the radial direction.

The novel features believed characteristic of the present invention are set forth in the appended claims. The invention itself, however, together with further objects and advantages thereof may best be understood with reference to the following description taken in connection with the accompanying drawings.

SUMMARY OF THE INVENTION

The invention is best understood in the environment of a gas turbine which includes a catalytic combustor burning a lean premixed fuel/air mixture to minimize thermal NOx formation. In such a combustor, the fuel and air react in a catalytic reactor prior to a transition zone and prior to input into the turbine portion of a gas turbine. According to the invention, the catalytic reactor is supported within an outer non-porous liner. A porous inner liner is included between the outer liner and the outer circumference of the catalytic reactor and is effective to provide a heat insulation as well as a cushion of air which surrounds and supports the catalytic reactor. The air is admitted into the space between the outer liner and the porous inner liner through at least one air inlet so that the air is pressurized to a pressure higher than the pressure of the combustion path so that, in effect, pressurized air leaks into the combustion path; while, as a corollary, leakage of unburned fuel/air mixture or combustion product through the porous liner is prevented. The support is self centering and reactive to radial movement of the catalytic reactor in that as the reactor moves radially towards the outer liner compressing the porous liner, the pressure within the porous liner will tend to rise and the increased pressure acting on the reactor surface tends to restore the reactor to a center position.

DETAILED DESCRIPTION OF THE INVENTION

Figure 1:
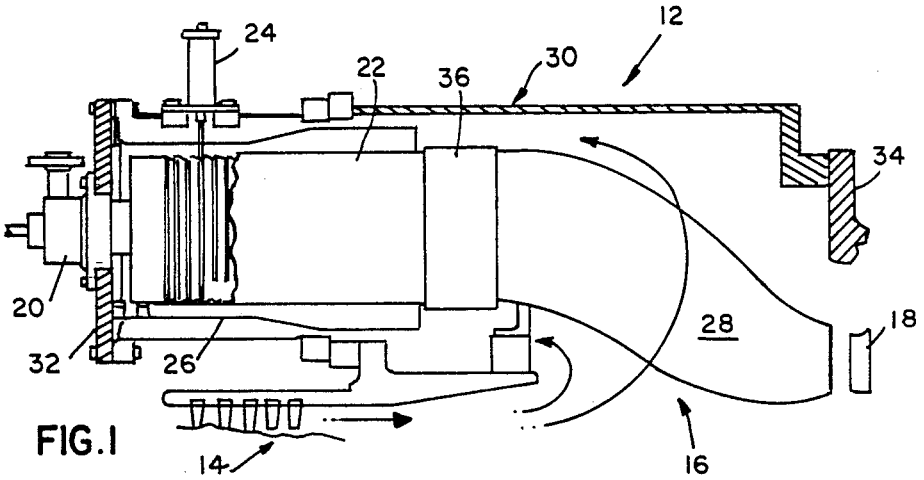
FIG. 1 is an elevation cross-section of a portion of a gas turbine which shows the position of the catalytic reactor with respect to other gas turbine parts.

FIG. 1 shows one embodiment of a gas turbine 12. The gas turbine includes a compressor section 14, a combustion section 16 and a turbine section 18 (illustrated figuratively by a single blade). The compressor section is driven by the turbine section through a common shaft connection which is not here shown but is well known. Also, it is well known that the modern gas turbine includes a plurality of combustors (only one shown). In one gas turbine model, there may be as many as fourteen combustors mounted about the turbine in an annular array. It should be emphasized that the present invention is adaptable to any number of gas turbine configurations different than the one which is shown herein, as an example, without altering the scope of the present invention.

Each combustor may include a fuel inlet nozzle 20, a combustion chamber 22 and an ignition means such as a spark plug 24. It is clear that fuel is input into the combustion chamber along with reverse flowed compressor discharge air (indicated by flow arrows) and is ignited by the spark plug to form a combustion mixture. The combustion chamber may be surrounded by a flow sleeve 26 which directs the compressor discharge air toward the combustion chamber. The combustion chamber discharges the combustion mixture into a transition zone 28 which is aligned at its discharge end with a turbine section 18.

A combustor wrapper 30 surrounds the combustion chamber and transition zone to contain the compressor discharge air and is closed at the fuel nozzle end by an end nozzle plate 32 and connected at its other end to a turbine shell 34. The combustion path, in general, comprises the combustion chamber and the transition zone. However, in a direct catalytic combustion process, the combustion path will further include a catalytic reactor 36. For purposes of the present invention, however, the previously described configuration is merely by way of example. For instance, in some gas turbine models it may be preferred to put the catalytic reactor upstream from the main combustion chamber. In general, this occurs when a preburner configuration is utilized the specifics of which are known in the art and would not change the practice of the present invention.

Figure 2:
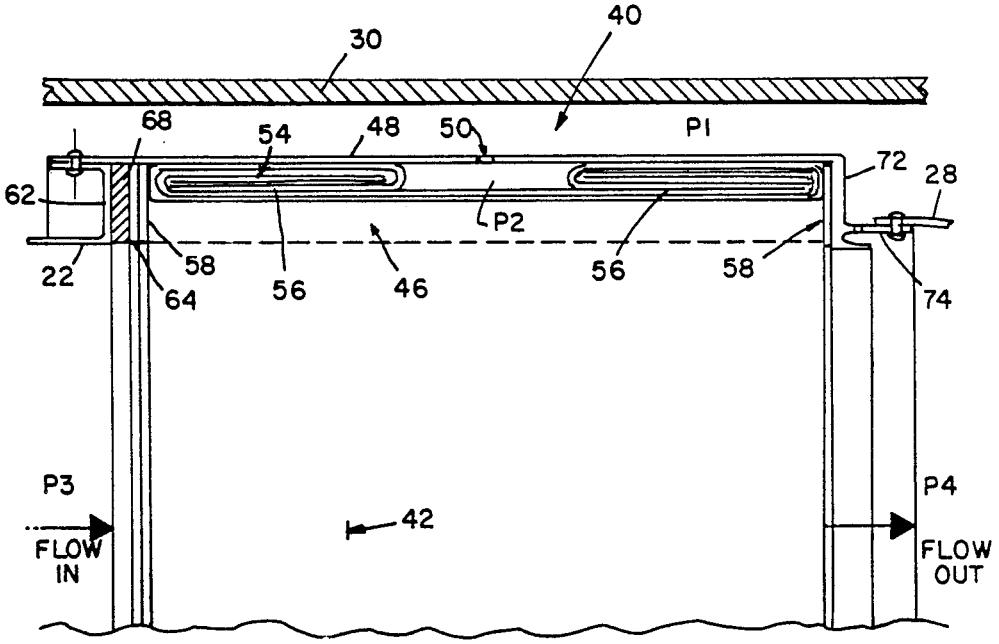
FIG. 2 is a detailed cross-section of the catalytic reactor and the support structure therefore in accordance with the preferred embodiment of the invention.

Turning to the present invention which is shown in partial half section in FIG. 2, a catalytic reactor support structure 40 is enveloped within the combustor wrapper 30. The catalytic reactor bed 42 is generally cylindrical in shape and may be formed from a ceramic material or substrate of "honeycomb cells" coated with a reaction catalyst on the surface. It is also possible that the substrate could be made of a metal material such as a high temperature stainless steel or other appropriate material without changing the application of the present invention. Any other substrate material would also be coated with a surface reaction catalyst. The cells at an outer annular portion 46 of the reactor bed are filled with solid material to provide a smooth, solid surface at the cylinder outer surface. The catalytic reactor bed is surrounded by a catalytic reactor support structure which includes an outer liner or catalytic reactor liner 48 in the form of a metal cylinder. Immediately upstream (in the direction of gas flow) from the outer liner there may be a mixing section such as the combustion chamber 22 and downstream from the outer liner there may be a reaction zone: or, as previously indicated the transition zone 28. The outer liner may be formed with a radially inwardly extending stop 72 on its downstream or exit end for the purpose of inhibiting the downstream axial movement of the catalyst bed whereas an axially extending lip 74 is provided for connection to the downstream next structure. Again, details of the upstream or downstream components, of the combustion path, are by way of example and not material to the invention of the catalytic reactor support apparatus except as a flanged connection.

As previously mentioned, the outer liner which surrounds the catalytic reactor bed is mounted within the envelope of the combustor wrapper so that the volume surrounding the outer liner is pressurized with compressor discharge air at a first pressure Pl. This high pressure air flows through the outer (catalytic reactor) liner 48 through air admission holes 50 into the annular volume between the catalytic reactor bed and the outer liner 48. This high pressure air fills a porous high temperature resistant cloth bag or inner liner 54 which surrounds the catalytic reactor bed. The high temperature cloth bag or inner liner may be made of alumina-boria-silica, available from 3M Company. There is a thick portion comprised of folds 56 at either end of the cloth bag for the purpose of locating the bag within the space between the outer liner and the cylindrical outer surface of the reactor bed and for enabling the bag to expand and contract. The air pressure within the inner liner 54 is at a value P2 which is lower than the air supply pressure (compressor discharge air) P1, and higher than the internal pressures, P3 upstream from the catalyst bed and P4 on the discharge or downstream side of the catalyst bed. Since the pressure P2 within the inner liner 54 is higher than the fuel/air mixture pressure P3 upstream from the reactor bed, the fuel/air mixture is prevented from flowing around the outer circumference of the catalytic reactor bed. Leakage flow through the inner liner is compressor discharge air which enters the fuel/air mixture upstream and downstream of the reactor bed.

Due to the porous nature of the inner liner, compressor discharge air leakage flow decreases as the catalytic reactor bed moves radially toward the outer or catalytic reactor liner compressing the inner liner or air bag. This causes pressure P2 to rise and the increased pressure acting on the catalytic reactor bed surface gives a restoring force to center the catalytic reactor bed within the outer liner. The inner liner can be replaced with any type of compliant seal which will cause pressure P2 to respond to displacements of the catalytic reactor bed relative to the outer liner as previously described. Since the catalytic reactor bed is supported on a cushion of air and does not contact the catalytic reactor liner (outer liner), mechanical shock and vibration loads on the liner are attenuated before reaching the catalytic reactor bed. The inner liner expands and contracts in volume freely to compensate for differential thermal expansions between the catalytic reactor bed and the outer liner. The inner liner in combination with the annular portion 46 of the catalytic reactor bed avoids the potential of overcooling the reactor bed from the compressor discharge air.

The catalytic reactor bed is loaded in the axial direction by the pressure drop from P3 at the inlet to P4 at the exit. This load is supported by the downstream reaction and or transition section 28. There is a high temperature compliant porous gasket 58, which may be cloth, at each end of the catalytic reactor bed which insulates the upstream and downstream structures from the catalytic reactor bed. The catalytic reactor bed is restrained in the axial direction by the combustion liner 62 with the axial load evenly distributed around the circumference of the catalytic reactor bed by a free floating load ring 64 and wave spring 68.

Having described the invention, it becomes apparent that the inventor has disclosed a relatively simple, reliable and inexpensive support apparatus for mounting a catalytic reactor bed in a gas turbine combustion system. The support apparatus must isolate the reactor bed from mechanical shock and vibration loads imposed on the combustion system, compensate for differential thermal expansions between the catalytic reactor bed and the surrounding outer liner, and prevent leakage flow of fuel/air mixture or products of combustion between the catalytic reactor bed and the surrounding support structure.

While there is described and shown what is considered to be, at present, the preferred embodiment of the invention, it is, of course understood that various other modifications may be made therein. It is intended to claim all such modifications as would fall within the true spirit and scope of the present invention.

What is claimed is:

1. A support for a catalytic reactor bed comprising:
an outer support liner surrounding the catalytic reactor bed;
a compliant inner liner, within the outer support liner, surrounding the catalytic reactor bed wherein the compliant inner liner is porous high temperature resistant cloth; and,
an air inlet through the outer liner for pressurizing the inner liner against the catalytic reactor bed.

2. The support liner recited in claim 1 wherein the catalytic reactor bed is cylindrical and includes a solid annular portion adjacent its circumference; and, the outer support liner is a metal cylinder spaced from the circumference of the reactor bed.

3. The support liner recited, in claim 1 wherein the inner liner is a bag-like cloth structure disposed between the outer liner and the catalytic reactor bed and characterized by folds at either end of the cloth.

4. The support structure recited in claim 1 wherein the outer liner is formed with an integral radially inwardly depending stop for inhibiting axial downstream movement of the catalytic reactor bed.

5. The support structure recited in claim 1 wherein the upstream end of the support liner abuts a combustion liner and wherein there are high temperature gaskets at either end of the support structure to isolate the reactor bed from upstream and downstream connected parts.

6. The support structure recited in claim 5 further including an upstream load ring and wave spring between the upstream combustion liner and the catalytic reactor bed.

7. A structure for supporting a catalytic reactor within a gas turbine combustor, the combustor being connected to receive compressor discharge air and the catalytic reactor being connected into a gas turbine combustion path, wherein the support structure comprises;
a support outer liner connected into the combustion path and surrounding a catalytic reactor bed;
a compliant inner liner disposed between the outer liner and the catalytic reactor bed wherein the inner liner is a porous, high temperature resistant cloth having a fold formed at either end; and,
an air inlet through the outer liner for pressurizing the inner liner with compressor discharge air whereby the catalytic reactor bed is supported in the radial direction by an inflated inner liner.

* * * * *